US011779500B2

(12) United States Patent
Falk et al.

(10) Patent No.: US 11,779,500 B2
(45) Date of Patent: Oct. 10, 2023

(54) SYSTEMS AND METHODS FOR CONTROLLING A HEATING COMPONENT FOR AN INFANT CARE STATION

(71) Applicant: GE Precision Healthcare LLC, Wauwatosa, WI (US)

(72) Inventors: Steven M. Falk, Baltimore, MD (US); Nagapriya Kavoori Sethumadhavan, Bangalore (IN)

(73) Assignee: GE Precision Healthcare LLC, Wauwatosa, WI (US)

( * ) Notice: Subject to any disclaimer, the term of this patent is extended or adjusted under 35 U.S.C. 154(b) by 267 days.

(21) Appl. No.: 17/235,373

(22) Filed: Apr. 20, 2021

(65) Prior Publication Data

US 2022/0331182 A1 Oct. 20, 2022

(51) Int. Cl.
*A61G 11/00* (2006.01)

(52) U.S. Cl.
CPC ..... *A61G 11/003* (2013.01); *A61G 2203/12* (2013.01); *A61G 2203/46* (2013.01)

(58) Field of Classification Search
CPC .. A61G 11/00; A61G 11/003; A61G 2203/12; A61G 2203/46
See application file for complete search history.

(56) References Cited

U.S. PATENT DOCUMENTS

2017/0347960 A1* 12/2017 Falk ..... A61B 5/1102
2018/0064595 A1* 3/2018 Srinivasan ..... A61B 5/055
2020/0147336 A1* 5/2020 Hobbs ..... A61M 16/0816

* cited by examiner

*Primary Examiner* — Samuel G Gilbert

(57) ABSTRACT

An infant care station is described herein that can include a heating component of a microenvironment of the infant care station, at least one temperature measuring device, and a processor. The processor can calculate a baseline temperature of the heating component using the at least one temperature measuring device and monitor the heating component using the at least one temperature measuring device to determine one or more operating characteristics. The processor can also detect, based at least in part on the baseline temperature, that the one or more operating characteristics exceed a predetermined threshold and generate a response that results in a correction of the temperature maintained by the heating component.

19 Claims, 5 Drawing Sheets

400

SYSTEMS AND METHODS FOR CONTROLLING A HEATING COMPONENT FOR AN INFANT CARE STATION

FIELD OF THE DISCLOSURE

This disclosure relates generally to improved infant care stations and, more particularly, to techniques for controlling a heating component of an infant care station.

BACKGROUND

The present disclosure generally relates to an infant care station, such as an incubator, an infant warmer, or a hybrid device, among others. Prematurely born infants can require specialized treatment and care due to their small size and still-developing organs and physiological systems. After being born, premature infants are typically placed in devices that create a carefully controlled micro-environment around the patient. The infant care station operates to control environmental conditions of the micro-environment, such as oxygen concentration, temperature, humidity, and light in such a manner as to promote the health and well-being of the infant patient.

One type of infant care station is generally referred to as an incubator in which the patient is placed within a physical enclosure and the temperature within the enclosure is carefully controlled with convective heating provided by a forced flow of heated air into the enclosure. Within the micro-environment, the oxygen concentration and humidity can also be accurately controlled.

Another type of infant care station is referred to as a radiant warmer. The radiant infant warmer has an overhead canopy with heating elements that produce radiant heat directed downward onto the infant patient to maintain the temperature of the infant patient.

Hybrid systems are another type of infant care station that incorporates both convective heating systems and radiant heating systems.

Infant care stations typically include various components that enable controlling a micro-environment within the infant care stations. For example, the infant care stations can have multiple operational elements that are accurately controlled to maintain the micro-environment at desired levels. For example, infant care stations can have any number of heating elements or heating components that provide radiant heating to infants placed into the infant care stations.

SUMMARY

This summary introduces concepts that are described in more detail in the detailed description. It should not be used to identify essential features of the claimed subject matter, nor to limit the scope of the claimed subject matter.

The present disclosure relates to an infant care station that creates a micro-environment for an infant patient. The micro-environment region is located around the infant patient and is controlled by the infant care station. In some examples, the infant care station can control or manage a heating component of the infant care station to ensure that an infant patient is receiving an expected amount of radiant heating.

In an aspect, an infant care station is described herein that can include a heating component of a microenvironment of the infant care station, at least one temperature measuring device, and a processor that can calculate a baseline temperature of the heating component using the at least one temperature measuring device. The processor can also monitor the heating component using the at least one temperature measuring device to determine one or more operating characteristics. In addition, the processor can detect, based at least in part on the baseline temperature, that the one or more operating characteristics exceed a predetermined threshold, and generate a response that results in a correction of the temperature maintained by the heating component.

In some examples, the at least one temperature measuring device can include a thermocouple, a resistor temperature detector, a thermistor, an infrared sensor, an integrated circuit temperature sensor, an infrared sensor, a thermometer, or a combination thereof. In some aspects, the processor can determine a maintenance issue in response to the detecting that the one or more operating characteristics exceed the predetermined threshold, wherein the predetermined threshold is determined based on device data. In some examples, the maintenance issue can include a covering placed over the infant care station, a heater malfunction, or a dish malfunction.

In some aspects, the infant care station can include a height adjustable component to raise a bed of the infant care station in response to the detecting that the one or more operating characteristics exceed the predetermined threshold. In some examples, the one or more operating characteristics include a temperature of a reflective dish of the heating component, a rise in temperature in relation to the baseline temperature, a rate of change in temperature of the reflective dish of the heating component, or a combination thereof. In some aspects, the response can include an alert indicating a temperature of the heating component exceeds the threshold, and the processor can transmit the alert to a display device coupled to the infant care station, a remote computing device, an alert provider component, or a combination thereof.

In some examples, the response can include providing additional power to the heating component. In some aspects, the processor can detect the predetermined threshold based on a static temperature deviation value associated with the heating component. In some examples, the at least one temperature measuring device can include a temperature measuring device positioned to measure ambient air temperature above the infant care station. In some aspects, the processor can generate a second response if the ambient air temperature exceeds an air temperature threshold, wherein the second response indicates a source of cold air or hot air.

In some examples, the processor can control power to the heating element, and the processor can increase the power to the heating element in response to the one or more operating characteristics indicating a temperature of a reflective dish of the heating component has exceeded the predetermined threshold. In some aspects, the calculating the baseline temperature of the heating component can include detecting, using the at least one temperature measuring device, a set of temperatures of a reflective dish of the heating component over a period of time following a manufacturing or initialization of the heating component. In some aspects, the response can include a set of service instructions to result in the correction of the temperature maintained by the heating component.

In an aspect, a method for operating an infant care station can include calculating a baseline temperature of a heating component using at least one temperature measuring device and monitoring an operating temperature of the heating component using the at least one temperature measuring device to determine one or more operating characteristics. The method can also include detecting, based at least in part on the baseline temperature and the operating temperature, that the one or more operating characteristics exceed a predetermined threshold and generating a response that results in a correction of the operating temperature maintained by the heating component.

In another aspect, a non-transitory machine-readable medium for operating an infant care station can include a plurality of instructions that, in response to execution by a processor, cause the processor to calculate a baseline temperature of a reflective dish of a heating component using at least one temperature measuring device. The instructions can also cause the processor to monitor an operating temperature of the reflective dish of the heating component using the at least one temperature measuring device to determine one or more operating characteristics and detect, based at least in part on the baseline temperature and the operating temperature, that the one or more operating characteristics exceed a predetermined threshold. Furthermore, the instructions can cause the processor to generate a response that results in a correction of the operating temperature maintained by the heating component, wherein the response comprises increasing power provided to the heating element in response to the one or more operating characteristics indicating a temperature of the reflective dish of the heating element has exceeded the predetermined threshold.

Various other features, objects, and advantages described herein will be made apparent from the following description taken together with the drawings.

BRIEF DESCRIPTION OF THE DRAWINGS

The drawings illustrate examples for implementing the techniques described herein. In the drawings.

DETAILED DESCRIPTION

Embodiments of the present disclosure will now be described, by way of example, with reference to FIGS. 1-5. Infant care stations can provide microenvironments for infant patients receiving medical care. Infant care stations, as referred to herein, can include incubators, warmers, or devices that support one or more features of incubators and warmers. In some examples, the infant care stations can include any number of heating components that can provide heat to an infant patient placed under the heating components. The heating components, as referred to herein, can include any suitable components that can provide or manage a temperature of a microenvironment of an infant care station. For example, the heating components can include a power controller that provides power to a radiant heating element coupled to a reflective dish, among other components that cause an infant care station to generate or provide heat. Over time, the heating components can degrade, and the amount of heat provided to the infant patient may not be within a predetermined threshold. In addition, the infant care stations can be operated in unexpected environments, which can include objects, such as blankets, being placed over the infant care stations, the infant care stations being placed in close proximity to heating and cooling vents, and the like. Therefore, the amount of heat provided to the infant patient by the heating components of an infant care station can vary unexpectedly so that a difference between the amount of heat provided to an infant patient and the expected amount of heat being provided exceeds a predetermined threshold. In some examples, the heating components of an infant care station can also shut down or lose power unexpectedly.

Techniques described herein enable controlling the operation of the heating components of an infant care station. In some examples, the infant care station can include any number of temperature measuring sensors coupled to a reflective dish or in close proximity to the back of the reflective dish. The temperature measuring sensors can detect sensor data indicating an operating temperature of the reflective dish. In some examples, a processor can analyze the sensor data to determine, based on the operating temperature of the reflective dish, if a heating component has malfunctioned or if an unexpected environmental condition has been encountered.

An advantage that may be realized in the practice of some examples of the described systems and techniques is an additional safety mechanism to control the temperature of a microenvironment of an infant care station. For example, the techniques herein include generating and providing an alert in response to detecting a malfunction or degradation of a heating component or in response to detecting an unexpected environmental condition, among others. Techniques for controlling the temperature of the microenvironment are described in greater detail below in relation to FIGS. 1-5.

Figure 1:
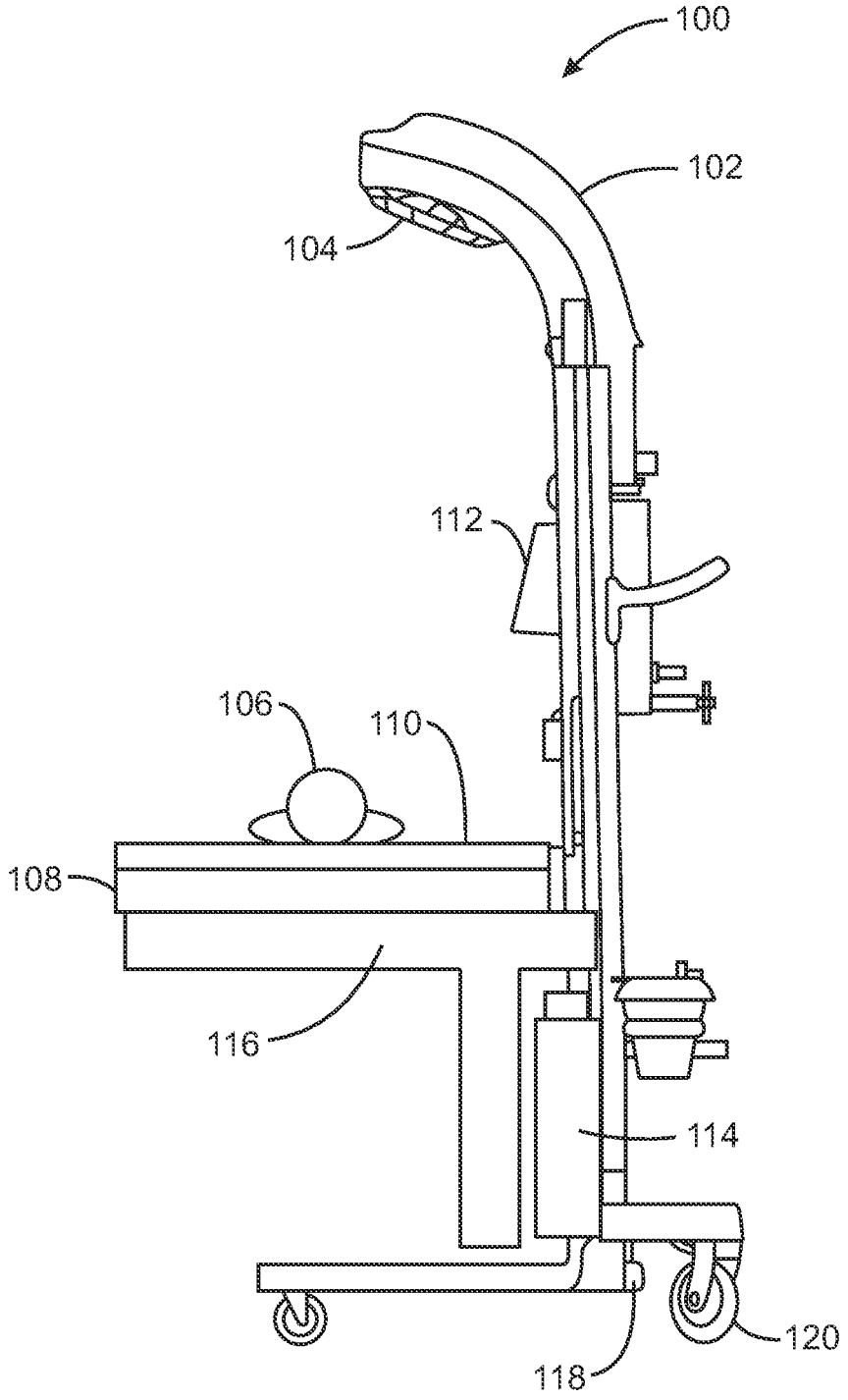
FIG. 1 is an environmental view that depicts an example type of an infant care station.

FIG. 1 is an environmental view that depicts an example type of an infant care station. For example, FIG. 1 depicts an example of an infant care station in which the infant care station is an infant warmer 100 that can provide heat to an infant patient in either a warmer configuration or an incubator configuration. In some examples, the infant warmer 100 can be configured as a hybrid infant care station that is operable between incubator and warmer modes. When the infant warmer 100 operates as a radiant warmer, a canopy 102 can include a radiant heater 104 located in the canopy 102 that produces radiant heat energy that is directed downward at the infant patient 106, and thereby operates to control the temperature of the infant patient 106. When the infant warmer 100 operates in an incubator configuration, the canopy 102 can be moved vertically closer to the horizontal surface 108 and the infant patient 106 thereby enclosing or partially enclosing the infant patient 106 in conjunction with the walls 110. The horizontal surface 108 can be configured to support the infant patient 106. It is to be understood that the infant warmer 100 may have the ability or control to move, rotate, or incline the horizontal surface 108.

One or more walls 110 extend generally vertically from the horizontal surface 108. In the embodiment depicted in FIG. 1 of the infant warmer 100, four walls 110 extend vertically from the horizontal surface 108 to define the rectangular shape of the warmer. However, it will be understood that in alternative embodiments, various numbers of walls 108 may be used to define the infant warmer 100 and the walls 108 may be arranged into various geometric shapes which may include, but are not limited to, circles or hexagons, among others.

The horizontal surface 108, walls 110, and canopy 102 define a microenvironment contained within these structures. The infant warmer 100 can be configured such that the microenvironment surrounds the infant patient 106 and provides the infant patient 106 with a controlled combination of environmental conditions (temperature, humidity, $O_2$ concentration, etc.) selected by a clinician to promote the health and wellbeing of the infant patient 106.

Figure 2:
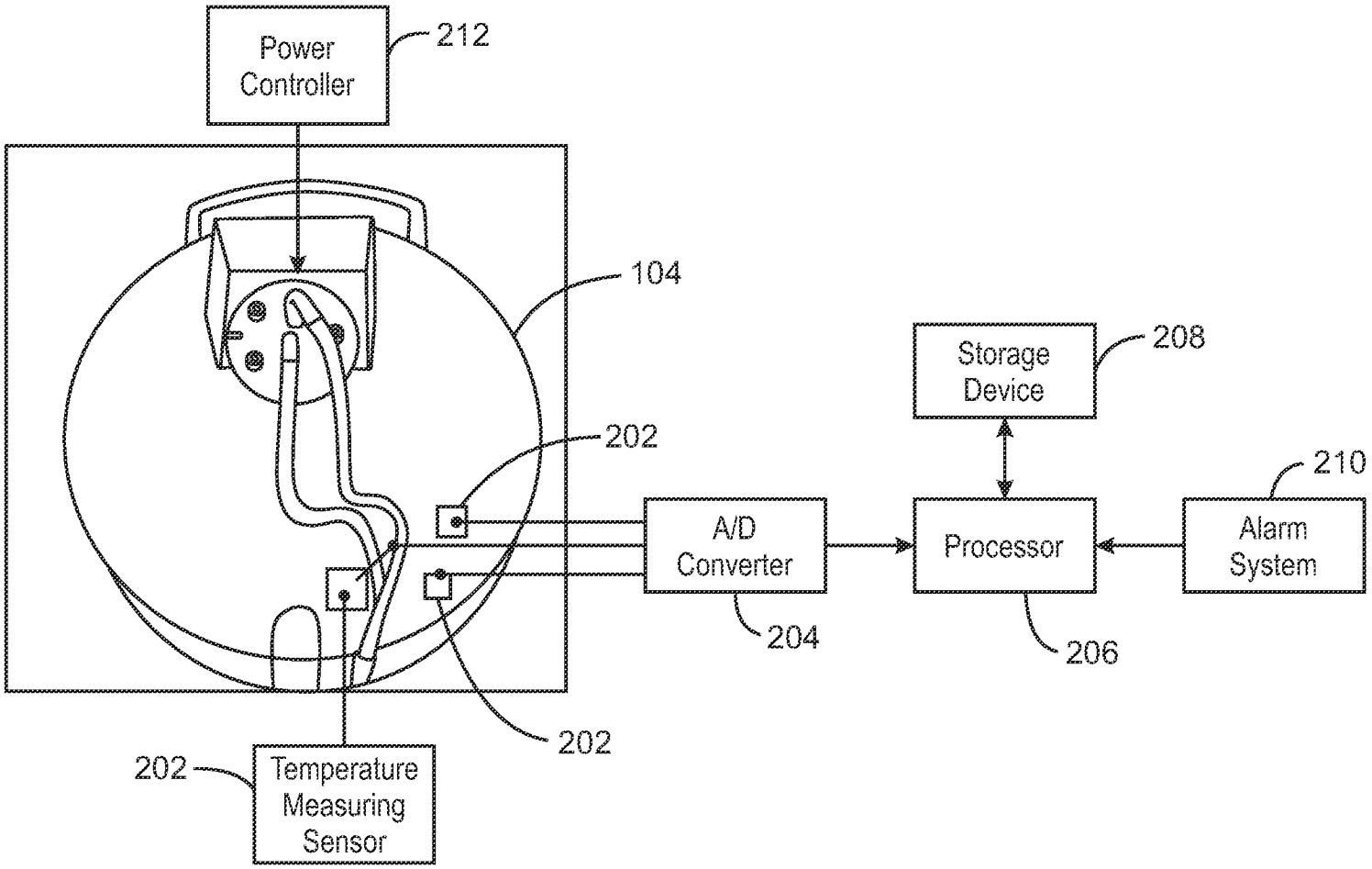
FIG. 2 is an example block diagram of components for controlling the heater of an infant care station.

In some examples, the canopy 102 extends over the horizontal surface 108 and the canopy 102 can be domed, rectangular, curved, or any other suitable shape. As depicted in FIG. 2 and described below in greater detail, the canopy 102 can include multiple components or surfaces that control or manage the heat that is provided to the infant patient 106. For example, the canopy 102 can include temperature measuring sensors (depicted in FIG. 2), processors (depicted in FIG. 2), and the like that can monitor the operating temperature of the radiant heater 104 and control the operation of the radiant heater 104 in response to detected variations in the operating temperature. For example, the radiant heater 104 can include a reflective dish and a heating element, among other components. The heating element can be coupled to a power modulator that increases or decreases an amount of heat provided by the heating element. The heating element can be a metal coil or any other suitable heating element. In some examples, the heating element resides in and may be coupled to the reflective dish of the radiant heater 104. The reflective dish can reflect the heat produced by the heating element so that the heat is directed away from the reflective dish towards an infant patient placed in the infant warmer 100.

In operation as an incubator, the infant warmer 100 may control the temperature of the infant patient 106 with a convective heater (not depicted), while in other examples, the convective heater and the radiant heater 104 may work in conjunction in order to effectively control the temperature of the infant patient 106.

The example of the infant warmer 100 depicted in FIG. 1 includes a touch-sensitive graphical display 112 built into the canopy 102 or mounted to the canopy 102. The graphical display 112 is operated by a processor (depicted in FIG. 2) to present a graphical user interface (GUI). In some examples, the graphical display 112 is a touch-sensitive graphical display and the GUI is configured to respond to inputs made by a clinician received through the touch-sensitive graphical display. During normal operation, the touch-sensitive graphical display 112 and touch-sensitive configured GUI are used to control various functions of the infant warmer 100 such as the radiant heater 104, among others. The GUI can present a variety of information, such as the air temperature and alarm indications, among others.

Non-limiting examples of the alarms that may be presented via the graphical display 112, or any other suitable alarm devices, can include, but are not limited to, threshold indications for physiological parameters such as excessive or insufficient respiration rate, excessive or insufficient temperature or disconnection of a physiological monitoring sensor, among others. The GUI can further present a variety of controls that control the power provided to the radiant heater 104, among others. In some examples, the GUI can provide patient trends that may present various physiological measurements obtained from the infant patient 106 over time. The physiological measurements may include, but are not limited to, temperature, respiration rate, heart rate, SpO2, weight, or any other information.

Examples of the infant warmer 100 can further include a pedestal 114 connected to the base 116. The pedestal 114 can include mechanical components (not depicted), which may include, but are not limited to, servo motors, rack and pinion systems, or screw gear mechanisms that are operable by foot pedals 118 to raise or lower the base 116, effectively raising or lowering the position of the infant patient 106 in relation to the clinician. As previously disclosed, the infant warmer 100 may be moveable by wheels or casters 120 connected to the pedestal 114.

In some examples, the canopy 102 of the infant warmer 100 can include any number of components to control or manage the radiant heater 104. The components are described in greater detail below in relation to FIG. 2.

It is to be understood that the block diagram of FIG. 1 is not intended to indicate that the infant warmer 100 is to include all of the components shown in FIG. 1. Rather, the infant warmer 100 can include fewer or additional components not illustrated in FIG. 1 (e.g., additional memory components, embedded controllers, additional modules, additional network interfaces, etc.).

FIG. 2 is an example block diagram of components for controlling the heater of an infant care station. In some examples, the canopy 102 of the infant warmer 100 can include any number of components such as temperature measuring sensors 202, analog to digital converters 204, processors 206, storage devices 208, alarm systems 210, and the like. The temperature measuring sensors 202 can be coupled to the back of a radiant heater 104, placed in close proximity to the radiant heater 104, or placed in any other suitable location proximate to the radiant heater 104. For example, the temperature measuring sensors 202 can be placed in any suitable pattern or at any suitable distance from one another along any portion of a radiant heater 104. The location of the temperature measuring sensors 202 can be determined based on analysis of the heating component, such as the radiant heater 104, to determine which area of the heating component experiences a temperature deviation that exceeds a threshold when the heating component performs unexpectedly. The heating component can include a reflective dish, a heating element, and a power component to cause the heating element to provide heat, among others. In some examples, the heating component can include any number of additional components such as power modulators, different types of heating elements, and the like.

As described in greater detail below in relation to FIG. 4, the temperature measuring sensors 202 can detect, determine, or otherwise obtain any number of temperature values that represent the operating temperature of the radiant heater 104 over a period of time. The temperature values may be obtained as analog signals that are processed by any number of analog to digital converters 204, which provide digital output values to at least one processor 206. The processor 206 can execute machine readable instructions stored in the storage devices 208 to analyze the digital output from the temperature measuring sensors 202 along with data from any other suitable sensors or data sources, such as sensors or devices that monitor a temperature of an infant patient 106 residing on the horizontal surface 108 of FIG. 1. In some examples, the processor 206 can determine a type of failure of the radiant heater 104 or a power controller 212 coupled to the radiant heater 104. The type of failure can indicate reflector degradation of the radiant heater 104, a heater degradation issue for the power controller 212, a material or object placed over the infant warmer 100, an external air source proximate to the infant warmer 100, among others.

The alarm systems 210 can provide feedback to a user indicating a type of failure of the infant warmer 100 using any suitable audio feedback, visual feedback, haptic feedback, or a combination thereof. In some examples, the visual feedback indicating a type of failure can be displayed by the graphical display 112, display device coupled to the infant warmer 100, or a display device in a remote location that can receive the feedback from the infant warmer 100.

It is to be understood that the block diagram of FIG. 2 is not intended to indicate that the infant warmer 100 is to include all of the components shown in FIG. 2. Rather, the infant warmer 100 can include fewer or additional components not illustrated in FIG. 2 (e.g., additional memory components, embedded controllers, additional modules, additional network interfaces, etc.). Furthermore, any of the functionalities of the processor 206 may be partially, or entirely, implemented in hardware.

Figure 3:
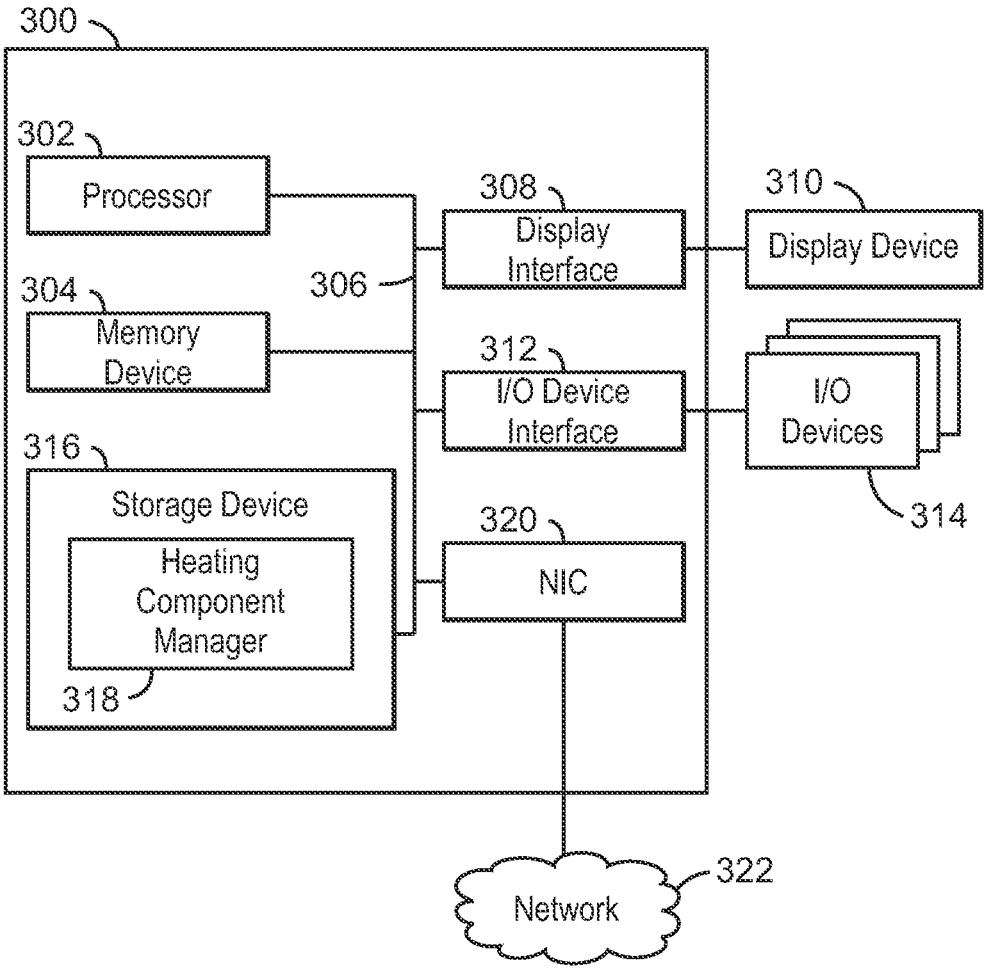
FIG. 3 depicts an example computing device that can control a heating component of an infant care station.

FIG. 3 is a block diagram of an example of a computing device that can control a heating component of an infant care station. The computing device 300 may be, for example, an infant warmer, an incubator, a hybrid infant care station, a laptop computer, a desktop computer, a tablet computer, or a mobile phone, among others. In some examples, the computing device 300 can be electronically coupled to an infant care station, communicate with the infant care station from a remote location, or reside within an infant care station. The computing device 300 may include a processor 302 that is adapted to execute stored instructions, as well as a memory device 304 that stores instructions that are executable by the processor 302. The processor 302 can be a single core processor, a multi-core processor, a computing cluster, or any number of other configurations. The memory device 304 can include random access memory, read only memory, flash memory, or any other suitable memory systems. The instructions that are executed by the processor 302 may be used to implement a method that can control a radiant heater, as described in greater detail below in relation to FIG. 4.

The processor 302 may also be linked through the system interconnect 306 (e.g., PCI, PCI-Express, NuBus, etc.) to a display interface 308 adapted to connect the computing device 300 to a display device 310. The display device 310 may include a display screen that is a built-in component of the computing device 300. The display device 310 may also include a computer monitor, television, or projector, among others, that is externally connected to the computing device 300. The display device 310 can include light emitting diodes (LEDs), and micro-LEDs, Organic light emitting diode OLED displays, among others.

The processor 302 may be connected through a system interconnect 306 to an input/output (I/O) device interface 312 adapted to connect the computing device 300 to one or more I/O devices 314 The I/O devices 314 may include, for example, a keyboard and a pointing device, wherein the pointing device may include a touchpad or a touchscreen, among others. The I/O devices 314 may be built-in components of the computing device 300 or may be devices that are externally connected to the computing device 300.

In some embodiments, the processor 302 may also be linked through the system interconnect 306 to a storage device 316 that can include a hard drive, an optical drive, a USB flash drive, an array of drives, or any combinations thereof. In some embodiments, the storage device 316 can include any suitable applications. In some embodiments, the storage device 316 can include a heating component manager 318 that can cause the processor 302 to calculate a baseline temperature of the heating component using at least one temperature measuring device and monitor the heating component using the at least one temperature measuring device to determine one or more operating characteristics. In some examples, the heating component manager 318 can also detect, based at least in part on the baseline temperature, that the one or more operating characteristics exceed a predetermined threshold and generate a response that results in a correction of the temperature maintained by the heating component. In some examples, the predetermined threshold can be a static value, a rate of change, or the like. The predetermined threshold can be detected, computed, or otherwise obtained based on device data from the device itself. For example, an infant care station can monitor device data including an operating temperature, or any other characteristic, of a radiant heater over a period of time and determine or compute an expected operating temperature, temperature range, change in temperature per time, or the like.

In some examples, a network interface controller (also referred to herein as a NIC) 320 may be adapted to connect the computing device 300 through the system interconnect 306 to a network 322. The network 322 may be a cellular network, a radio network, a wide area network (WAN), a local area network (LAN), or the Internet, among others. The network 322 can enable data, such as alerts, among other data, to be transmitted from the computing device 300 to remote computing devices, remote display devices, and the like. In some examples, the NIC 320 can enable controlling the settings of an infant care station using a remote system accessible by the network 322 For example, the NIC 320 may provide a remote system with a capability to control or otherwise manage a heating component of an infant care station via the computing device 300.

It is to be understood that the block diagram of FIG. 3 is not intended to indicate that the computing device 300 is to include all of the components shown in FIG. 3. Rather, the computing device 300 can include fewer or additional components not illustrated in FIG. 3 (e.g., additional memory components, embedded controllers, additional modules, additional network interfaces, etc.). Furthermore, any of the functionalities of the heating component manager 318 may be partially, or entirely, implemented in hardware and/or in the processor 302. For example, the functionality may be implemented with an application specific integrated circuit, logic implemented in an embedded controller, or in logic implemented in the processor 302, among others. In some embodiments, the functionalities of the heating component manager 318 can be implemented with logic, wherein the logic, as referred to herein, can include any suitable hardware (e.g., a processor, among others), software (e.g., an application, among others), firmware, or any suitable combination of hardware, software, and firmware.

Figure 4:
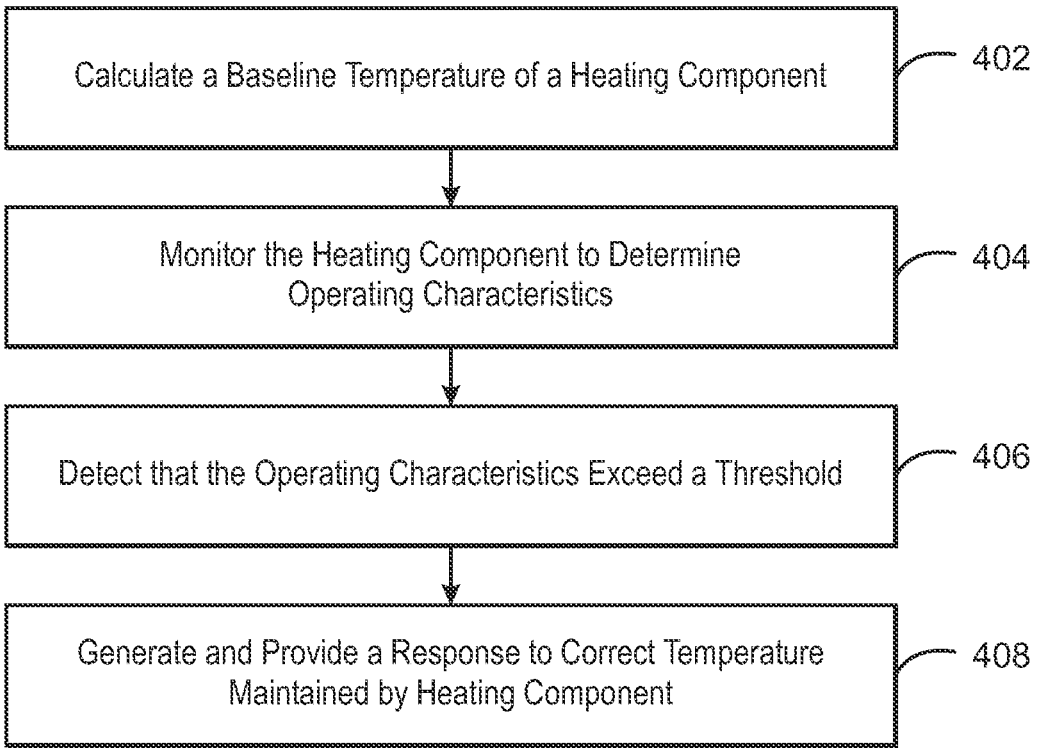
FIG. 4 depicts a process flow diagram of an example method for controlling the operation of an infant care station.

FIG. 4 depicts a process flow diagram of an example method for controlling the operation of an infant care station. In some examples, the method 400 can be implemented with any suitable infant care station, such as the infant warmer 100 of FIG. 1, or the computing device 300 of FIG. 3, among others.

At block 402, the method 400 can include calculating a baseline temperature of a heating component for an infant care station using any number of temperature measuring devices. In some examples, the method 400 can calculate the baseline temperature of the heating component by detecting or otherwise obtaining, using at least one temperature measuring device, a set of operating temperatures of a reflective dish of the heating component over a period of time following a manufacturing or initialization of the heating component. For example, the baseline temperature can be calculated by detecting a median value, a mean value, a weighted average value, or the like using any number of operating temperatures detected during a baseline calculation period. In some examples, the baseline temperature can be detected in any suitable measurement such as Celsius, Fahrenheit, or Kelvin, among others. The baseline temperature period can include temperatures calculated at any suitable frequency such as one temperature per minute, one temperature per hour, one temperature per day, or the like. In some examples, the frequency of time for collecting, detecting, or otherwise obtaining the baseline temperature can be static or dynamic. For example, the frequency of time for obtaining the baseline temperature values can vary based on a time in operation since initialization or manufacturing of the heating component, or a continuous period of time during which the heating component is providing radiant heating, among others. The baseline temperature value that is obtained based on any number of temperature readings during a period of time can be stored and compared against operating temperatures as described in greater detail below in relation to block 406.

In some examples, the baseline temperature values can be obtained at any suitable physical location on a heating component or adjacent to the heating component. For example, the baseline temperature values can be detected from any suitable sensors coupled to a reflective dish that provides radiant heating to a microenvironment for an infant care station. In some examples, the sensors are coupled to the back of the reflective dish and the sensors detect baseline temperatures based on the operating temperature of the reflective dish. Any number of sensors can be used to obtain the baseline temperatures. For example, one sensor, two sensors, three sensors, or more, can be attached to the reflective dish or placed in proximity to the reflective dish in order to detect the operating temperature of the reflective dish. The sensors can include any suitable temperature measuring device such as a thermocouple, a resistor temperature detector, a thermistor, an infrared sensor, an integrated circuit temperature sensor, an infrared sensor, a thermometer, or a combination thereof. In some examples, the sensors can reside inside a housing of an infant care station so that the sensors are located between a reflective dish and the housing of the infant care station.

At block 404, the method 400 can include monitoring the heating component using the at least one temperature measuring device to determine one or more operating characteristics. In some examples, circuitry can be electronically coupled to one or more sensors detecting the temperature of the reflective dish. The circuitry can include an analog to digital converter to convert analog signals from any number of sensors to digital data. The circuitry can also include a microprocessor, one or more memory devices, communication devices, and the like. The microprocessor can execute instructions stored in the one or more memory devices to process and analyze digital data obtained from the sensors, the analog to digital converters, or a combination thereof.

In some examples, the operating characteristics can include an operating temperature of a reflective dish of the heating component at a particular time, a rise in temperature of the reflective dish of the heating component in relation to the baseline temperature, a rate of change in temperature of the reflective dish of the heating component, or a combination thereof. The operating characteristics can be independently determined for each heating component, the operating characteristics can be based on any number of heating components within a particular facility or location, or the operating characteristics can be dynamically configured based on user input or the like.

In some examples, the operating characteristics can be measured using a static time period or dynamically based on an age of a heating component, a time during which a heating component provides radiant heating, or a combination thereof.

At block 406, the method 400 can include detecting, based at least in part on the baseline temperature, that the one or more operating characteristics exceed a predetermined threshold. For example, the method 400 can include determining that the operating characteristics indicate that a temperature of the heating component has increased at a rate that exceeds a threshold, that the operating temperature of the heating component exceeds a threshold, or a combination thereof. In some examples, the method 400 can include comparing the operating characteristics to the baseline temperature of a heating component, such as a reflective dish, among others. A deviation between the operating characteristics and the baseline temperature can be measured and compared to a predetermined threshold in order to detect a potential issue with an infant care station.

In some examples, the method 400 can include detecting or otherwise obtaining the predetermined threshold based on a static temperature deviation value associated with the heating component. The static temperature deviation value can be identified from a table storing any number of different heating components and associated static temperature deviation values. For example, each model or brand of a heating component can have different temperature deviations provided by a reflective dish of the heating component.

At block 408, the method 400 can include generating and providing a response that results in a correction of the temperature maintained by the heating component. The response can indicate a temperature of the heating component exceeds the threshold, and result in a transmission of an alert to a display device coupled to the infant care station, a remote computing device, an alert provider component, or a combination thereof. The alert provider component can include circuitry to drive a color or brightness of light emitting diodes in the infant care station or electronically coupled to the infant care station, haptic feedback sensors, or the like. In some examples, the response can include providing additional power to the heating component. For example, a heating element coupled to a reflective dish can receive additional power, which results in the generation of additional radiant heating to the microenvironment of an infant care station.

In some examples, the response can include a set of service instructions that results in the correction of the temperature maintained by the heating component. For example, the response can include instructions that increase or decrease a temperature maintained by a heating component by increasing or decreasing power provided to the heating component or heating element coupled to a reflective dish.

In some examples, the method 400 can include determining a maintenance issue in response to the detecting that the one or more operating characteristics exceed the predetermined threshold. The maintenance issue can include a covering placed over the infant care station, a heater malfunction, or a reflective dish malfunction or a heating element malfunction. For example, a rapid rate of temperature increase of the heating component can indicate an obstruction, such as a blanket, among others, may have been placed over an infant care station. In some examples, the response can indicate to a user to remove an obstruction resulting in a higher temperature of an infant care station. In some examples, a gradual rise in temperature over a period of time can indicate a loss of reflectivity of a reflective dish, which can indicate that the amount of radiant heating provided by a reflective dish has been reduced.

In some examples, the method 400 can include generating and providing a response that results in a correction of the temperature maintained by the heating component and the determination of a maintenance issue. For example, a gradual decrease in temperature of the reflective dish can indicate that the heating element is degrading and is unable to provide the same power output. In such a case, the method 400 can include increasing power to the heating element to provide the same heating to the infant patient and also to indicate to a user that maintenance (replacement of the heating element or the like) is needed. An estimate of the amount of time the heating component can be used can also be provided based on the rate of decrease of the temperature of the reflective dish. In some examples, the response can also indicate to reduce power to the heating element coupled to a reflective dish in order to maintain a predetermined temperature of an infant patient if the heating element is providing an amount of radiant heat that exceeds a threshold value.

The process flow diagram of method 400 of FIG. 4 is not intended to indicate that all of the operations of blocks 402-408 of the method 400 are to be included in every example. Additionally, the process flow diagram of method 400 of FIG. 4 describes a possible order of executing operations. However, it is to be understood that the operations of the method 400 can be implemented in various orders or sequences. In addition, in some examples, the method 400 can also include fewer or additional operations. For example, a temperature measuring device can be positioned to measure ambient air temperature above the infant care station and the method 400 can include generating a second response if the ambient air temperature exceeds an air temperature threshold, wherein the second response indicates a source of cold air or hot air. For example, the second response can indicate that an infant care station is placed in close proximity to a heating or cooling vent that is affecting the temperature of the microenvironment for an infant patient. The second response can be provided using a display device, any suitable alarm system, such as LEDs, haptic feedback, and audio feedback, among others.

In some examples, an infant care station can include a height adjustable component and the method 400 can include raising a bed of the infant care station in response to the detecting that the one or more operating characteristics exceed the predetermined threshold. For example, the method 400 can include automatically raising the bed or horizontal setting when the temperature of the heating component is greater than or less than expected.

Figure 5:
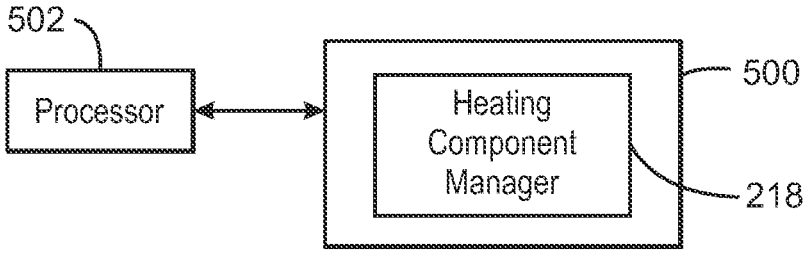
FIG. 5 depicts a block diagram of an example non-transitory machine executable media for controlling the operation of an infant care station.

FIG. 5 is an example of a non-transitory machine-readable medium for controlling the operation of an infant care station, in accordance with examples. The non-transitory, machine-readable medium 500 can cause a processor 502 to implement the functionalities of method 400. For example, a processor of a computing device (such as processor 302 of computing device 300 of FIG. 3), an infant warmer 100, or any other suitable device, can access the non-transitory, machine-readable media 500.

In some examples, the non-transitory, machine-readable medium 500 can include instructions to execute a heating component manager 218. For example, the non-transitory, machine-readable medium 500 can include instructions for the heating component manager 218 that cause the processor 502 to calculate a baseline temperature of a heating component using at least one temperature measuring device and monitor the heating component using the at least one temperature measuring device to determine one or more operating characteristics. In some examples, the heating component manager 218 can also detect, based at least in part on the baseline temperature, that the one or more operating characteristics exceed a predetermined threshold and generate a response that results in a correction of the temperature maintained by the heating component.

In some examples, the non-transitory, machine-readable medium 500 can include instructions to implement any combination of the techniques of the method 500 described above.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

Embodiments of the present disclosure shown in the drawings and described above are example embodiments only and are not intended to limit the scope of the appended claims, including any equivalents as included within the scope of the claims. Various modifications are possible and will be readily apparent to the skilled person in the art. It is intended that any combination of non-mutually exclusive features described herein are within the scope of the present invention. That is, features of the described embodiments can be combined with any appropriate aspect described above and optional features of any one aspect can be combined with any other appropriate aspect. Similarly, features set forth in dependent claims can be combined with non-mutually exclusive features of other dependent claims, particularly where the dependent claims depend on the same independent claim. Single claim dependencies may have been used as practice in some jurisdictions require them, but this should not be taken to mean that the features in the dependent claims are mutually exclusive.

What is claimed is:

1. An infant care station comprising:

a heating component for a microenvironment of the infant care station;

at least one temperature measuring device; and a processor to:

calculate a baseline temperature of the heating component using the at least one temperature measuring device;

monitor the heating component using the at least one temperature measuring device to determine one or more operating characteristics;

detect, based at least in part on the baseline temperature, that the one or more operating characteristics exceed a predetermined threshold; and generate a response that results in a correction of an operating temperature maintained by the heating component.

2. The infant care station of claim 1, wherein the at least one temperature measuring device comprises a thermocouple, a resistor temperature detector, a thermistor, an infrared sensor, an integrated circuit temperature sensor, an infrared sensor, a thermometer, or a combination thereof.

3. The infant care station of claim 1, wherein the processor is to determine a maintenance issue in response to the detecting that the one or more operating characteristics exceed the predetermined threshold, wherein the predetermined threshold is determined based on device data.

4. The infant care station of claim 3, wherein the maintenance issue comprises a covering placed over the infant care station, a heater malfunction, or a dish malfunction.

5. The infant care station of claim 1, wherein the infant care station comprises a height adjustable component to raise a bed of the infant care station in response to the detecting that the one or more operating characteristics exceed the predetermined threshold.

6. The infant care station of claim 1, wherein the one or more operating characteristics include a temperature of a reflective dish of the heating component, a rise in temperature in relation to the baseline temperature, a rate of change in temperature of the reflective dish of the heating component, or a combination thereof.

7. The infant care station of claim 1, wherein the response comprises an alert indicating a temperature of the heating component exceeds the predetermined threshold, and wherein the processor is to transmit the alert to a display device coupled to the infant care station, a remote computing device, an alert provider component, or a combination thereof.

8. The infant care station of claim 1, wherein the response comprises providing additional power to the heating component.

9. The infant care station of claim 1, wherein the processor is to detect calculate the predetermined threshold based on a static temperature deviation value associated with the heating component.

10. The infant care station of claim 1, wherein the at least one temperature measuring device comprises a temperature measuring device positioned to measure ambient air temperature above the infant care station.

11. The infant care station of claim 10, wherein the processor is to generate a second response if the ambient air temperature exceeds an air temperature threshold, wherein the second response indicates a source of cold air or hot air.

12. The infant care station of claim 1, wherein the processor is to control power to the heating element, and wherein the processor is to increase the power to the heating element in response to the one or more operating characteristics indicating a temperature of a reflective dish of the heating component has exceeded the predetermined threshold.

13. The infant care station of claim 1, wherein the calculating the baseline temperature of the heating component comprises detecting, using the at least one temperature measuring device, a set of temperatures of a reflective dish of the heating component over a period of time following a manufacturing or initialization of the heating component.

14. A method for operating an infant care station comprising:

calculating a baseline temperature of a heating component using at least one temperature measuring device;

monitoring an operating temperature of the heating component using the at least one temperature measuring device to determine one or more operating characteristics;

detecting, based at least in part on the baseline temperature and the operating temperature, that the one or more operating characteristics exceed a predetermined threshold; and generating a response that results in a correction of the operating temperature maintained by the heating component.

15. The method of claim 14, wherein the at least one temperature measuring device comprises a thermocouple, a resistor temperature detector, a thermistor, an infrared sensor, an integrated circuit temperature sensor, an infrared sensor, a thermometer, or a combination thereof.

16. The method of claim 14, comprising determining a maintenance issue in response to the detecting that the one or more operating characteristics exceed the predetermined threshold.

17. The method of claim 16, wherein the maintenance issue comprises a covering placed over the infant care station, a heater malfunction, or a reflective dish malfunction.

18. The method of claim 14, comprising increasing power provided to the heating element in response to the one or more operating characteristics indicating a temperature of a reflective dish of the heating component has exceeded the predetermined threshold.

19. A non-transitory machine-readable medium for operating an infant care station comprising a plurality of instructions that, in response to execution by a processor, cause the processor to:

calculate a baseline temperature of a reflective dish of a heating component using at least one temperature measuring device;

monitor an operating temperature of the reflective dish of the heating component using the at least one temperature measuring device to determine one or more operating characteristics;

detect, based at least in part on the baseline temperature and the operating temperature, that the one or more operating characteristics exceed a predetermined threshold; and generate a response that results in a correction of the operating temperature maintained by the heating component, wherein the response comprises increasing power provided to the heating element in response to the one or more operating characteristics indicating a temperature of the reflective dish of the heating element has exceeded the predetermined threshold.

* * * * *